US008385753B2

(12) United States Patent
Arai

(10) Patent No.: US 8,385,753 B2
(45) Date of Patent: Feb. 26, 2013

(54) IMAGE FORMING APPARATUS WITH AN OPERATOR PART REPLACEMENT MODE

(75) Inventor: Hiroyuki Arai, Hachioji (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 323 days.

(21) Appl. No.: 12/854,924

(22) Filed: Aug. 12, 2010

(65) Prior Publication Data

US 2011/0052218 A1 Mar. 3, 2011

(30) Foreign Application Priority Data

Aug. 25, 2009 (JP) ..... 2009-194486

(51) Int. Cl.
*G03G 15/00* (2006.01)

(52) U.S. Cl. ..... 399/11; 399/24; 399/37; 399/81

(58) Field of Classification Search ..... 399/11, 399/24, 37, 81
See application file for complete search history.

(56) References Cited

U.S. PATENT DOCUMENTS

| | | | | |
|---|---|---|---|---|
| 6,314,249 | B1 * | 11/2001 | Lay et al. | 399/11 |
| 7,877,034 | B2 * | 1/2011 | Nakamura et al. | 399/81 |
| 8,081,328 | B2 * | 12/2011 | Kudo | 358/1.14 |
| 2005/0259288 | A1 * | 11/2005 | Minato | 358/1.13 |
| 2005/0271400 | A1 * | 12/2005 | Okamoto et al. | 399/21 |
| 2007/0180159 | A1 * | 8/2007 | Takahashi | 710/8 |
| 2009/0016763 | A1 * | 1/2009 | Nakamura et al. | 399/90 |
| 2009/0097871 | A1 * | 4/2009 | Ikeda | 399/44 |
| 2009/0317099 | A1 * | 12/2009 | Masumoto et al. | 399/31 |
| 2010/0150581 | A1 * | 6/2010 | Nakamura et al. | 399/18 |

FOREIGN PATENT DOCUMENTS

| | | | |
|---|---|---|---|
| JP | 62-069277 | A | 3/1987 |
| JP | 7-112565 | A | 5/1995 |
| JP | 2007-208528 | A | 8/2007 |
| JP | 2007-248538 | A | 9/2007 |
| JP | 2008-281601 | A | 11/2008 |
| JP | 2008-299156 | A | 12/2008 |
| JP | 2009-020334 | A | 1/2009 |
| JP | 2009-122207 | A | 6/2009 |
| JP | 2010-060792 | A | 3/2010 |

* cited by examiner

*Primary Examiner* — David Gray
*Assistant Examiner* — G. M. Hyder
(74) *Attorney, Agent, or Firm* — Buchanan Ingersoll & Rooney PC

(57) ABSTRACT

An image forming apparatus for forming an image based on image data, includes: a power source for supplying power to various sections of the apparatus; a display section for displaying; and a control section for executing a controlling regarding operations of the apparatus, wherein the control section is provided with a normal power supply mode representing a state of normal power supply, and a power supply mode for operator part replacement representing the state of power supply different from said normal power supply mode, the power supply mode for operator part replacement to which an operator changes the state of power supply on changing a part or a unit of the apparatus.

22 Claims, 10 Drawing Sheets

IMAGE FORMING APPARATUS WITH AN OPERATOR PART REPLACEMENT MODE

CROSS REFERENCE TO RELATED APPLICATION

The present application is based on Japanese Patent Application No. 2009-194486 filed with Japanese Patent Office on Aug. 25, 2009, and the entire content of which is hereby incorporated by reference.

FIELD OF THE INVENTION

The present invention relates to an image forming apparatus for forming an image based on image data, particular an image forming apparatus that allows an operator to replace parts or units.

BACKGROUND OF THE INVENTION

In an image forming apparatus such as a photocopier, printer, facsimile and multi-functional peripheral wherein an image is formed based on image data, a document is exposed to an exposure lamp to read the reflected light, and an image data is generated. Based on this image data, an electrostatic latent image is formed on a photoconductor drum or the like by a writing unit using laser light. This electrostatic latent image is developed by the development unit containing toner and developer, and is transferred directly or through a transfer belt onto the sheet supplied by a sheet feed roller. After that, the toner is fixed onto the sheet by the pressure and heat applied by a fixer.

The approximate service life of the aforementioned parts such as photoreceptor drum, development unit, sheet feed roller, transfer belt, and fixing device are determined by the number of uses. These parts are designed to be replaceable, and are replaced at appropriate intervals, whereby high image quality can be maintained. In the conventional method, replacement, maintenance and inspection of these parts and units have been taken care of exclusively by a serviceman familiar with the structure of the apparatus. In the recent digital printing industry, replacement of the aforementioned parts can be performed quickly by an operator handling the apparatus, without having to wait for the dispatch of a serviceman.

Incidentally, to allow the maintenance, inspection and replacement of the parts to be performed, the image forming apparatus is provided with an open/close-type door. This open/close-type door is normally closed. Only when the aforementioned work is to be performed, the open/close-type door is opened to perform the work. The main body of such an apparatus incorporates a charging device that operates at a high voltage and a fixing device being heated to a high temperature. If these devices are kept operating with the open/close-type door open, working safety will not be ensured. Thus, the conventional image forming apparatus is provided with an interlock switch that operates in synchronism with the opening and closing of the door. When the door is opened, the power of the apparatus is automatically turned off by the interlock switch. When the open/close-type door has been closed, power supply is started to allow the operation to be performed (Unexamined Japanese Patent Application Publication No. Sho 62 (1987)-69277).

Generally, operators have a lower level of skill than servicemen. It is preferred that operators confirm the replacement work procedure during the replacement work. However, in the conventional image forming apparatus, at the time of parts replacement, the apparatus power is turned off by opening the open/close-type door. This makes it necessary to use a label or manual as instructions for the parts replacement procedure. When the parts replacement procedure is complicated particularly in the parts replacement work of a sophisticated large-sized apparatus, it is very difficult to instruct the operator on the details of the replacement procedure. Another problem is that, in the conventional image forming apparatus, the power of the apparatus is turned off in the replacement mode. Thus, the apparatus itself is incapable of determining if the parts have been replaced or not. This fails to notify the operator of the replacement on a real-time basis. Thus, in cases wherein the operator closes the door or turns on power without the parts and others having been completely replaced, the initial operation of the apparatus starts as the power is turned on, and the machine may be seriously damaged due to incomplete replacement. In the conventional art, there is an increase in the aforementioned risk because the replacement work having been done by the serviceman alone is released to the operator.

In view of the problems described above, it is an object of the present invention to provide an apparatus for ensuring safety and reliable replacement work to be performed in cases wherein the parts and units of the apparatus are replaced by an operator.

SUMMARY OF THE INVENTION

To achieve at least one of the above mentioned objects, an image forming apparatus for forming an image based on image data reflecting one aspect of the present invention comprises: a power source for supplying power to various sections of the apparatus; a display section for displaying; and a control section for executing a controlling regarding operations of the apparatus, wherein the control section is provided with a normal power supply mode representing a state of normal power supply, and a power supply mode for operator part replacement representing the state of power supply different from said normal power supply mode, the power supply mode for operator part replacement to which an operator changes the state of power supply on changing a part or a unit of the apparatus.

DETAILED DESCRIPTION OF THE PREFERRED EMBODIMENT

Figure 1:
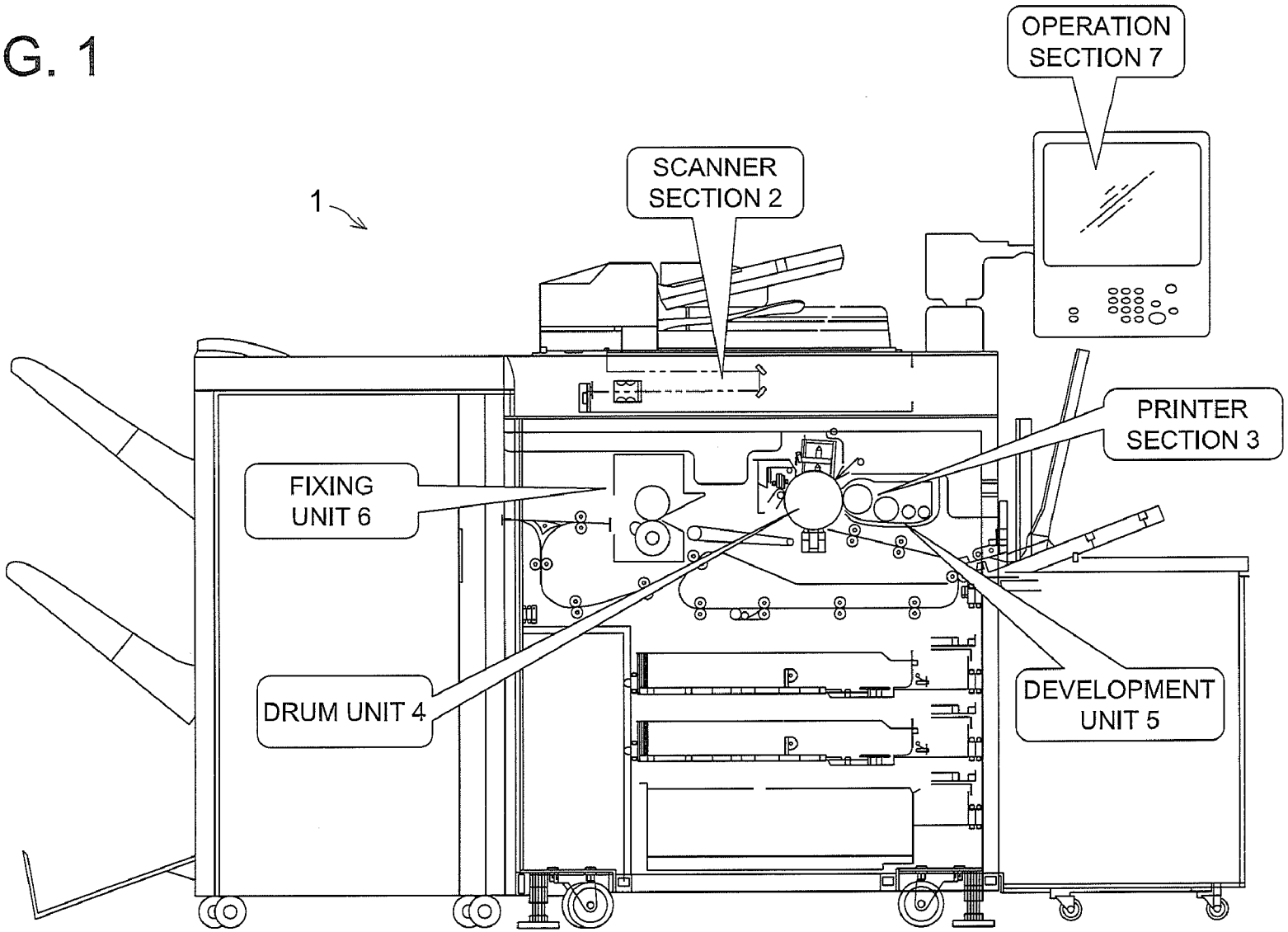
FIG. 1 is a diagram representing the mechanical outline of an image forming apparatus as an embodiment of the present invention.

The following describes an embodiment of the present invention. FIG. 1 is a diagram representing the mechanical outline of an image forming apparatus in the present invention.

The top of the image forming apparatus 1 is provided with a scanner section 2 including a CCD and exposure lamp. The document is read by the scanner section 2 and image data is acquired. The image forming apparatus 1 includes a printer section 3 for forming an image on a sheet based on the image data obtained by the scanner section 2 and others. This printer section 3 is provided with a drum unit 4 for image formation, a development unit 5, and a fixing unit 6. The drum unit 4, development unit 5, and fixing unit 6 are assumed as the units to be replaced by the operator. When an image is formed, a latent image is formed on the drum of the drum unit 4 based on the image data by an image writing section 19 (to be described later). This latent image is developed by a development unit 5. After that, the latent image is transferred onto the sheet conveyed inside the apparatus. The image transferred onto the sheet is heated and pressed by the fixing roller of the fixing unit 6, whereby the image is fixed in position.

The upper portion of the image forming apparatus 1 is provided with an operation section 7 consisting of a touch panel and others to enable information display and instruction input by the operator. To be more specific, this operation section 7 functions as a display section of the present invention.

Figure 2:
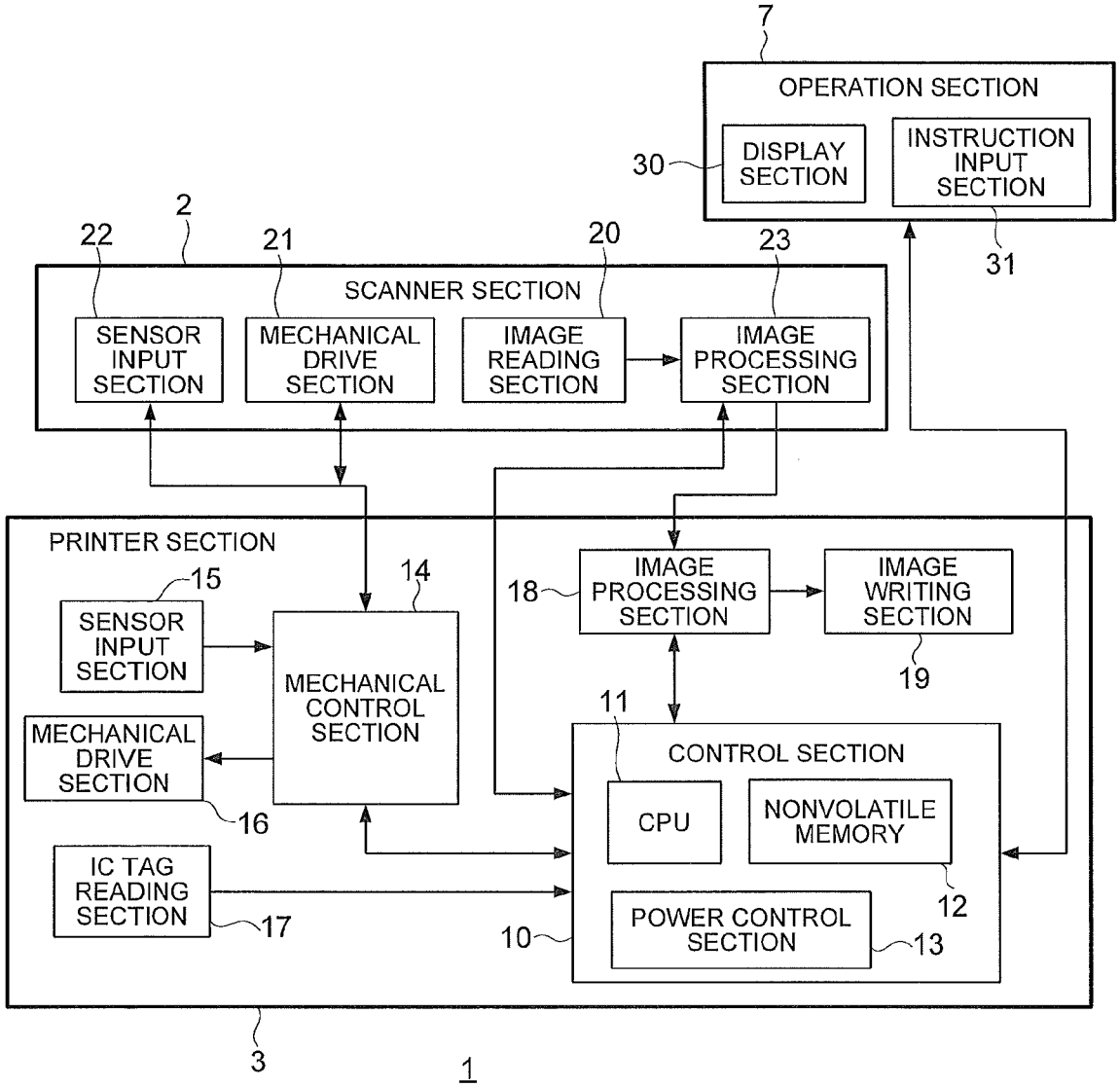
FIG. 2 is a block diagram representing the state of power supply in the normal power supply mode.

FIG. 2 is a diagram representing part of the function block of the image forming apparatus 1. The following describes the details:

The printer section 3 includes a control section 10 to control the image forming apparatus 1 as a whole. The control section 10 is provided with a CPU 11 for executing program processing, a nonvolatile memory 12 for nonvolatile storage of the data such as a program, process control parameter and data, and a power control section 13 for controlling the apparatus power. The CPU 11 is capable of reading the nonvolatile data of the nonvolatile memory 12, and writing the desired data as nonvolatile data into the nonvolatile memory 12. The CPU 11 controls the operations of each part of the image forming apparatus 1 according to the aforementioned process control parameters and others. In response to the instruction from the CPU 11, the power control section 13 controls the on-off operation of the power supply for various parts of the image forming apparatus 1.

The control section 10 is connected with a mechanical control section 14. In response to the instruction from the control section 10, the mechanical control section 14 controls the operations of each mechanical drive section 16 provided on the image forming apparatus 1. The mechanical drive section 16 constitutes part of the drive section of the present invention. This mechanical drive section 16 drives the conveyance roller for conveying the sheet in the image forming apparatus 1 and drum unit 4. This mechanical control section 14 is connected with the sensor input section 15 provided with a printer section 3 so as to enable signal exchange. The sensor input section 15 is connected with a plurality of detecting sections (not illustrated) through cables and connectors. In the printer section 3, a detecting section detects the position of the sheet being conveyed in the image forming apparatus 1.

The aforementioned control section 10 is connected with an IC tag reading section 17. The IC tag reading section 17 reads the IC tag information provided on the parts and units to be replaced, and sends the information to the control section 10. The printer section 3 has an image processing section 18 connected with the aforementioned control section 10. This image processing section 18 is connected with an image writing section 19. The image processing section 18 takes charge of compression and decompression of the image data, and generation of the written data for image writing section 19 from the image data. Based on the written data, the image writing section 19 writes a latent image on the drum of the drum unit 4, as described above. The image data having been compressed by the image processing section 18 is sent to the control section 10 as required, and is temporarily stored in the storage section such as a RAM or HDD (not illustrated).

The aforementioned scanner section 2 includes:

an image reading section 20 for reading a document image;

a mechanical drive section 21 for moving an optical system such as an exposure lamp as part of the image reading section 20;

a sensor input section 22 for receiving the input of the detecting section for detecting the sheet position and others; and an image processing section 23 that applies image processing such as analog processing, analog-to-digital conversion, and shading correction to the image data obtained by the image reading section 20.

The mechanical drive section 21 is controlled by the mechanical control section 14 according to the instruction of the control section 10. The image processing section 23 provides image processing according to the instruction of the control section 10. The sensor input section 22 is connected with the aforementioned mechanical control section 14 so as to exchange signals.

The operation section 7 is connected with the control section 10, and includes a display section 30 for displaying appropriate information and an instruction input section 31 for allowing the operator to input the instruction. The display section 30 displays the appropriate information under the control of the control section 10, and the information inputted through the instruction input section 31 is sent to the control section 20, wherein the information is subjected to appropriate processing.

Figure 3:
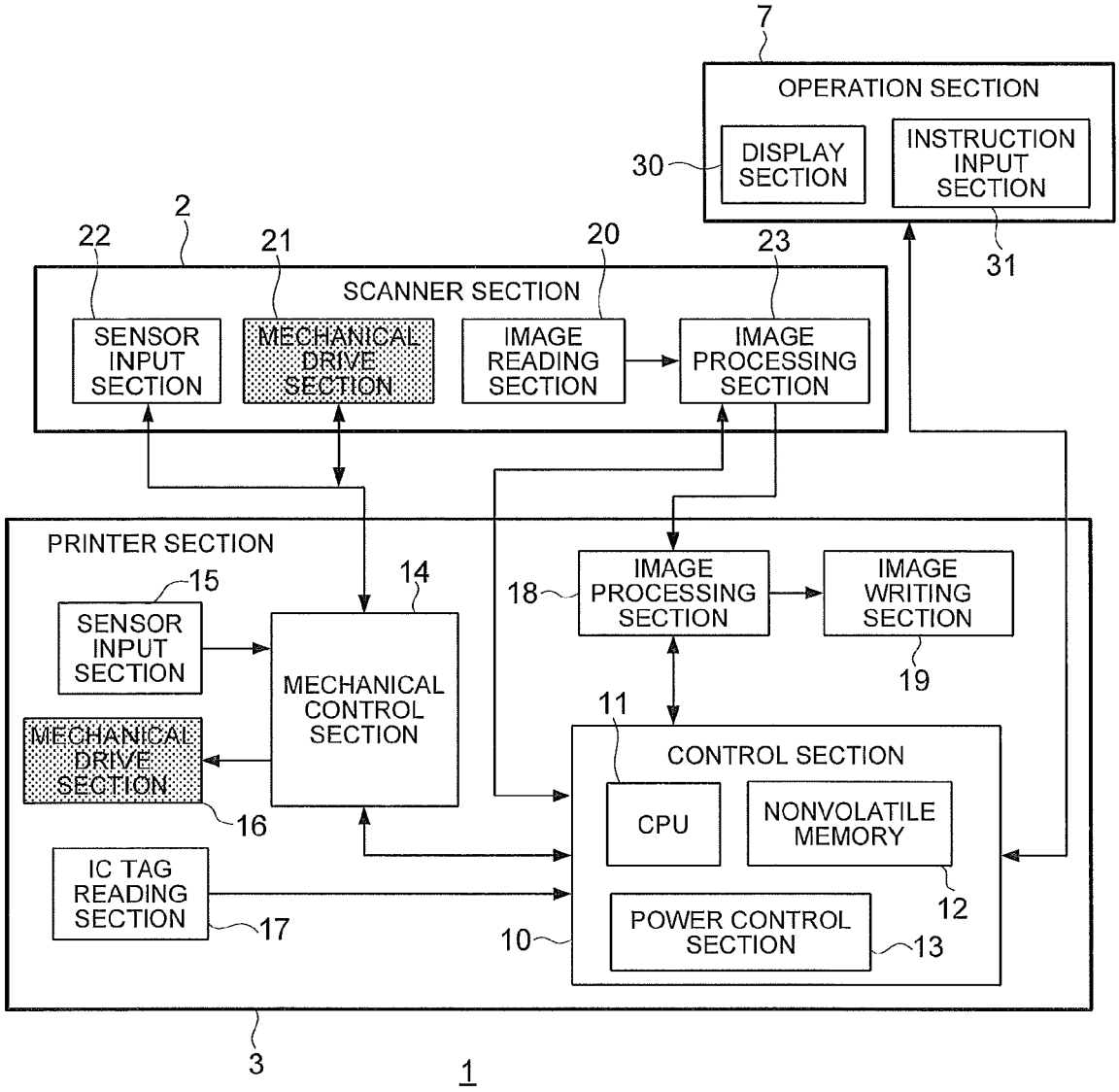
FIG. 3 is a block diagram representing the state of power supply in the service mode.

The aforementioned control section 10 permits selection from among a plurality of power supply modes characterized by different states of power supply, as one form of processing in the image forming apparatus as a whole. As one of the power supply states, a normal power supply mode is provided to supply power to all the loads. Thus, in the normal power supply mode, power is supplied to all the function blocks shown in FIG. 2. As another power supply state, a service mode is provided to allow the serviceman to maintain and inspect the apparatus. In this service mode, supply of power to the crosshatched drive sections (mechanical drive sections 16 and 21) is cut off, as shown in FIG. 3, and power is supplied to other loads.

Figure 4:
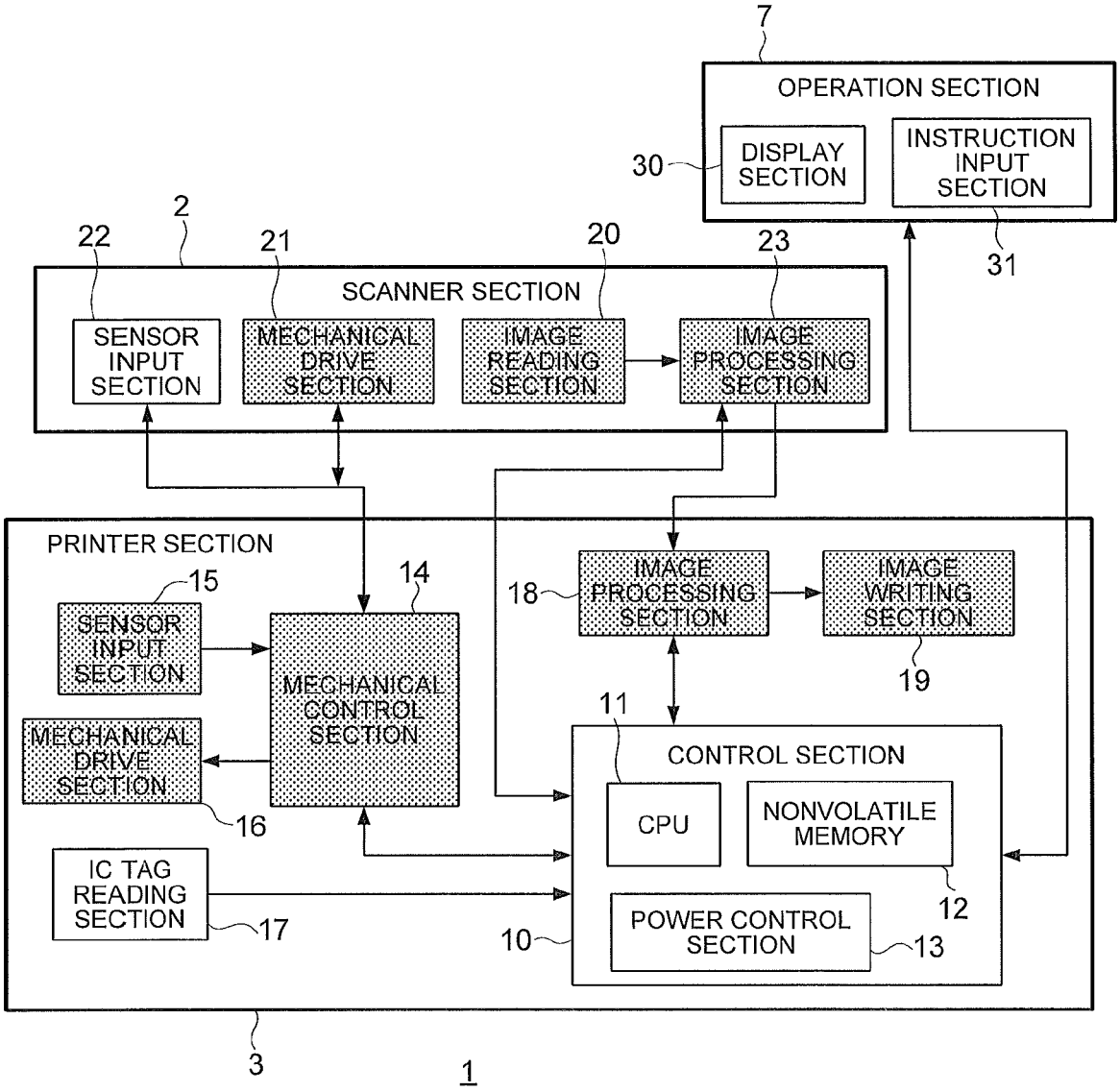
FIG. 4 is a functional block diagram representing the state of power supply in the power supply mode when parts are replaced by an operator.

Further, as still another state of power supply, a power supply mode for operator parts replacement is provided so that the parts or units can be replaced by the operator. In the power supply mode for operator parts replacement, power is supplied only to the control section 10, operation section 7, and IC tag reading section 17, as shown in FIG. 4. Supply of power to other drive sections or the mechanical control section is blocked. In the aforementioned normal power supply mode, service mode, and power supply mode for operator parts replacement, the power control section 13 controls supply of power to each load according to the instruction of the CPU 11 of the control section 10.

Figure 5A:
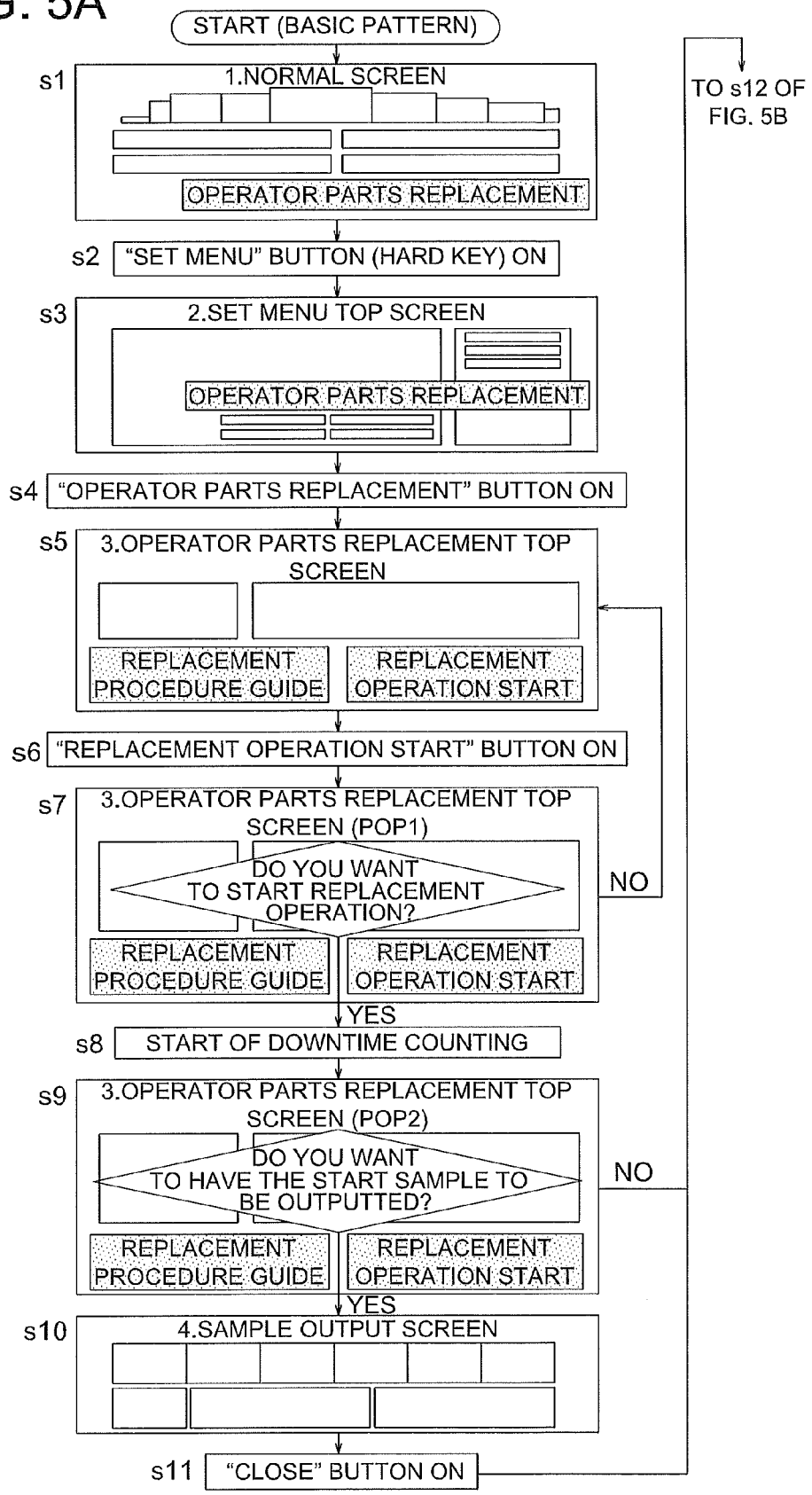
FIGS. 5A and 5B are flowcharts representing the replacement control procedure in the normal replacement mode.
Figure 5B:
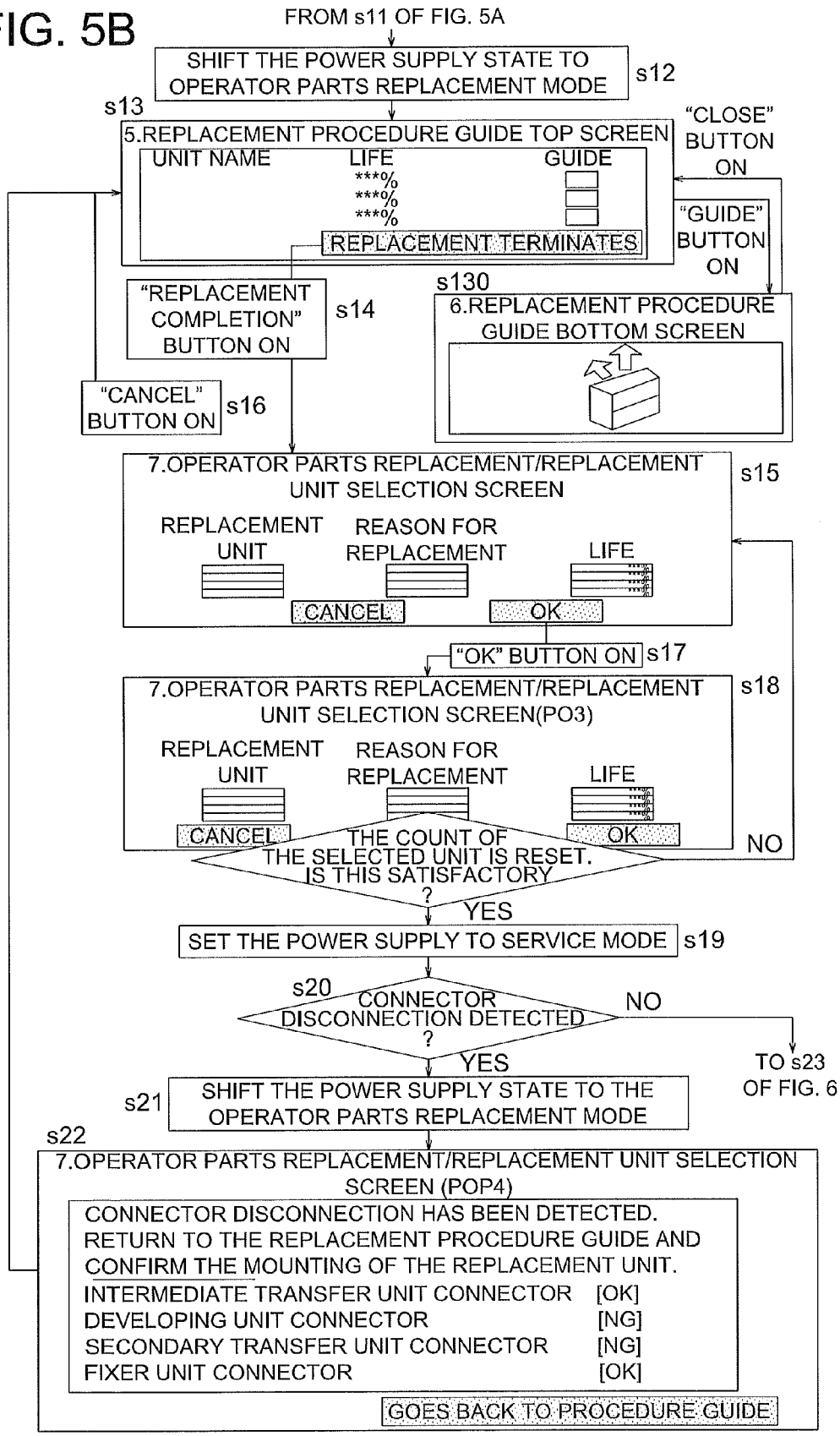
Figure 6:
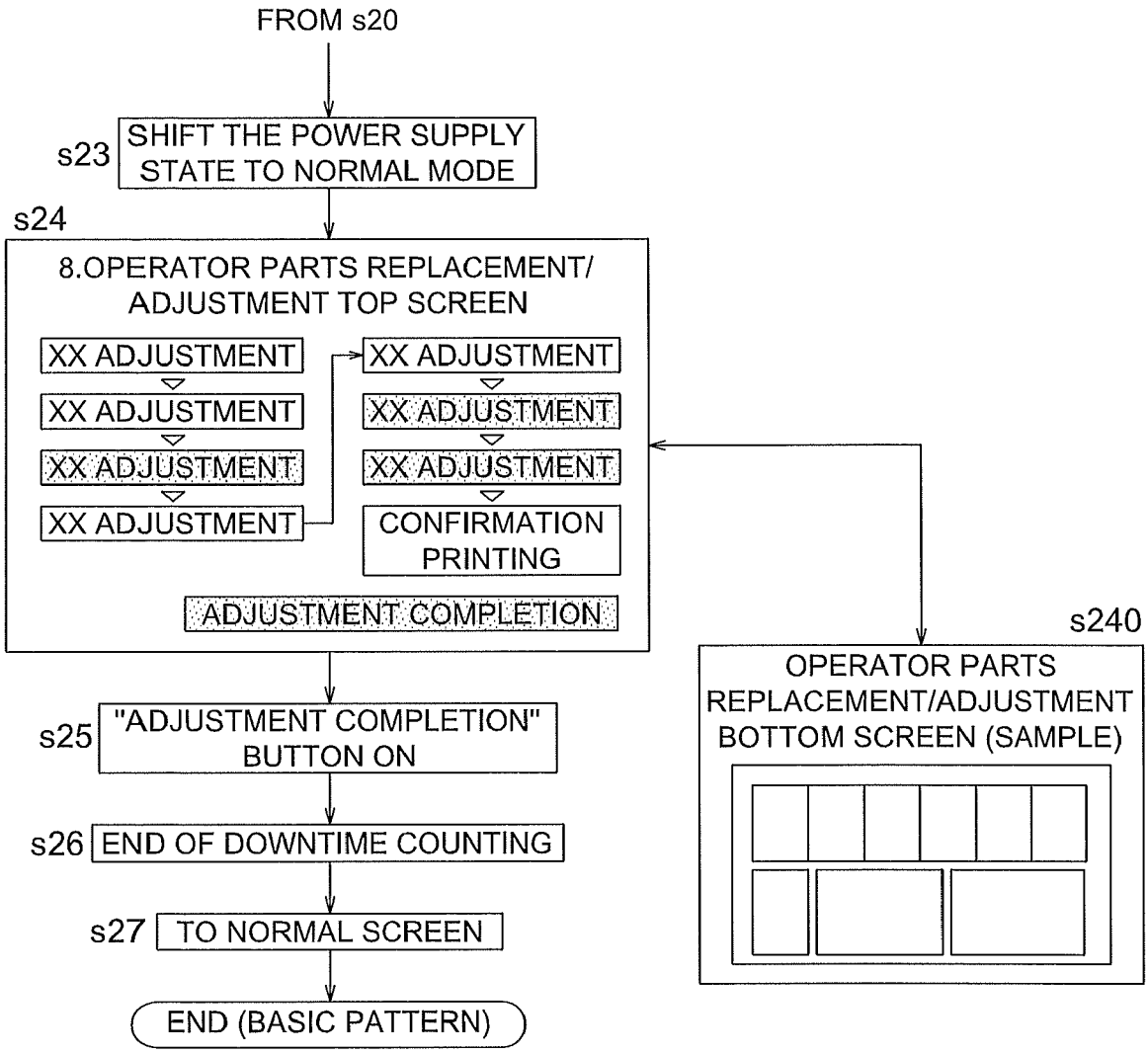
FIG. 6 is a flowchart representing the replacement control procedure in the normal replacement mode.

Referring to the accompanying flow chart, the following describes the control procedures by the control section 10 in the replacement of the parts and others by the operator:

In the first place, control procedures in the normal replacement mode of FIGS. 5 and 6 will be explained.

In the control section 10, the normal screen is displayed on the operation section 7 by the display section 30 as a basic state. On this normal screen, the operator is allowed to input instructions using the instruction input section 31. Further, the control section 10 manages the life of the parts or units that require replacement. If any one of them has reached the end of the service life, an operator parts alarm icon is added on the normal screen and is displayed on the normal screen (Step s1).

If the operator turns on the setting menu button displayed on the normal screen, the button is turned on (Step s2), and a setting menu TOP screen is displayed on the operation section 7 so that an instruction can be inputted (Step s3). If the operator presses the operator replacement parts button displayed on the setting menu TOP screen, the button is turned on (Step 4), and the operator parts replacement TOP screen is displayed on the operation section 7 so that instructions can be inputted (Step s5). The operator parts replacement TOP screen shows a replacement procedure guide button and a replacement work start button. In this case, the replacement work start button allows the instruction to be inputted. When the replacement work start button has been pressed by the operator (Step s6), a pop-up screen (POP 1) is displayed on the operator parts replacement TOP screen to inquire about the stmt of replacement work (Step s7). If selection is made not to start the replacement work ("No" in Step s7), the pop-up display goes off, and only the operator parts replacement TOP screen is displayed (to Step s5). In the pop-up screen POP 1, if the operator makes a replacement work start declaration, namely, if the operator has notified start of replacement work ("Yes" in Step s7), counting of the downtime as the replacement time starts (Step s8).

Then a pop-up screen POP 2 appears on the operator parts replacement TOP screen to inquire whether a sample should be outputted or not, taking the place of the pop-up screen POP 1 (Step s9). If the operator has made a selection not to output the sample ("No" in Step s9), the operation goes to Step s12 (to be described later) without executing the Step s10.

If the operator has selected outputting of the sample on the pop-up screen POP 2 ("Yes" in Step s9), the sample output screen appears on the operation section 7 to enable instructions to be inputted (Step s10). When the operator performs predetermined setting on this sample output screen to select the outputting of a sample, a confirmation sample is outputted. After the confirmation sample has been outputted, the operator turns on the close button on the sample output screen (Step s11). Then the button turns on and the control section 10 shifts to the state of power supply to the power supply mode for operator parts replacement (Step s12). To be more specific, power is supplied only to the control section 10, operation section 7, and IC tag reading section 17, as shown in FIG. 4. In this case, the control section 10 allows the power supply mode for operator parts replacement to be stored in the nonvolatile memory 12.

When the mode has shifted to the power supply mode for operator parts replacement, the replacement procedure guide TOP screen is displayed on the operation section 7 (Step s13). The name of the unit to be replaced, life percentage of each unit, and guide button are displayed on the replacement procedure guide TOP screen. When the guide button has been pressed, a replacement procedure guide BOTTOM screen conforming to the relevant unit is displayed on the operation section 7, whereby a specific guidance is given (Step s130). When the "close button" is pressed on the replacement procedure guide BOTTOM screen, the operation goes back to Step s13, and the replacement procedure guide TOP screen appears on the operation section 7.

After the replacement procedure guide TOP screen has appeared, the operator is allowed to replace desired parts and units by referring to the replacement procedure guide BOTTOM screen as required. In this case, power is not supplied to the drive section, sensor input section or the like, in such a way that operation safety is ensured without the apparatus being damaged. If the guide is not needed or replacement has been completed, the close button of the replacement procedure guide TOP screen is pressed, as described above. Then the replacement procedure guide TOP screen appears.

The replacement work completion button is displayed on the replacement procedure guide TOP screen so that instructions can be inputted. When the operator has pressed the replacement work completion button at the end of the replacement work, the button turns on (Step s14). Then replacement completion is assumed to have been notified by the operator, and an operator parts replacement/replacement unit selection screen appears on the operation section 7 (Step s15). When replacement completion has been notified by the operator, the IC tag of the unit is read by the IC tag reading section 17.

The replacement unit, reason for replacement, and life percentage are displayed on the operator parts replacement/replacement unit selection screen so that related information can be written. The operator selects the replacement unit button, and inputs the name of the replaced parts and the reason for replacement. If a unit is determined to have been replaced judging from the information read from the IC tag, the state of selection is automatically enabled on the operator parts replacement/replacement unit selection screen, with the state of non-selection being disabled. The state of setting is stored in the nonvolatile memory 12. If the Cancel button is pressed on this operator parts replacement/replacement unit selection screen, the button turns on (Step s16), and the operation goes back to Step s13 with the setting of each replacement unit kept unchanged. Then the replacement procedure guide TOP screen appears on the operation section 7.

When the OK button has been pressed on the operator parts replacement/replacement unit selection screen, the button turns on (Step s17), and a pop-up screen POP 3 is displayed on the operator parts replacement/replacement unit selection screen to inquire about the suitability of resetting the counter of the selected unit (Step s18). If the resetting is not selected ("No" in Step s18), the operation goes back to Step s15. The pop-up screen POP 3 is deleted and selection of the replacement unit is disabled. If resetting is possible ("Yes" in Step s18), the state of power supply shifts to the service mode (Step s19). As shown in FIG. 3, only the supply of power to the mechanical drive sections 16 and 21 is cut off, and supply of power to other loads is resumed.

By the transmission and reception of the signal to and from each of the sensor input sections through the mechanical control section 14, the control section 10 detects whether the connector is removed or not from the detecting section (Step s20). If removal of the connector is not detected ("No" in Step s20), replacement is regarded as having been completed correctly, and the state of power supply shifts to the normal power supply mode (Step s23). In the meantime, if removal of the connector is detected ("Yes" in Step s20), replacement work is correctly performed. Accordingly, the state of power supply is changed from the service mode to the power supply mode for operator parts replacement (Step s21). Then the pop-up screen POP 4 showing the connection of each connector is displayed on the operator parts replacement/replacement unit selection screen so that the normally connected sensor can be visually distinguished from the one from which the connector is removed (Step s22). The button for going back to the manual guide is displayed on this screen so that instructions can be inputted. If this button is pressed, the operation goes back to Step s13 with the replacement unit selection state kept unchanged. The replacement procedure guide TOP screen is displayed on the operation section 7 so that replacement work can be performed again.

After the mode has changed to the normal power supply mode in Step s23, the operator parts replacement/adjustment TOP screen is displayed on the operation section 7. The adjustment item button and confirmation print button are displayed (Step s24). In this case, of the adjustment item buttons, unwanted items are crosshatched to disable the selection, depending on replacement units. Automatically performed items are displayed to notify the state thereof. The confirmation print button should be made selectable by all means, or it is preferred that confirmation printing should be performed automatically. If the selectable adjustment item button or confirmation print button has been pressed, the operator parts replacement/adjustment BOTTOM screen conforming to the adjustment item is displayed to permit a desired instruction to be inputted. The operator is allowed to give an instruction to implement the adjustment item or confirmation sample (Step s240).

Upon completion of the automatically executed adjustment item or selected adjustment item, and confirmation printing, the adjustment work completion button is pressed, and the button turns on (Step s25). When the button turns on, the control section 10 stores the normal power supply mode in the nonvolatile memory. This is then followed by completion of counting of the downtime started simultaneously with replacement (Step s26). The downtime having been counted can be stored in the appropriate storage section so that this information can be used. After that, the normal screen is displayed on the operation section 7 (Step s27). Thus, the operation goes into the basic operation mode and replacement flow terminates.

Figure 7A:
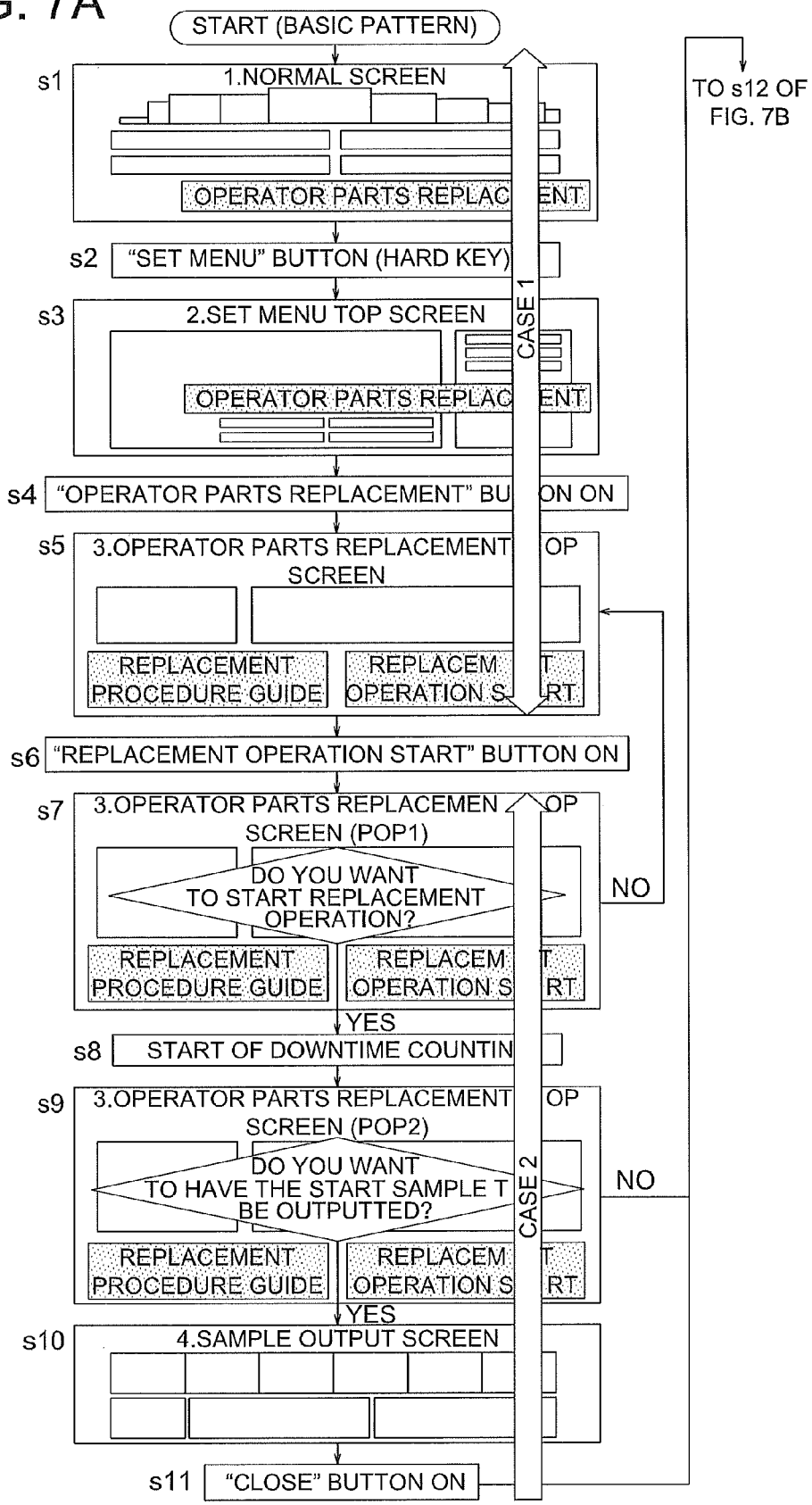
FIGS. 7A and 7B are flowcharts representing the replacement control procedure when power is turned off in the middle of replacement work.
Figure 7B:
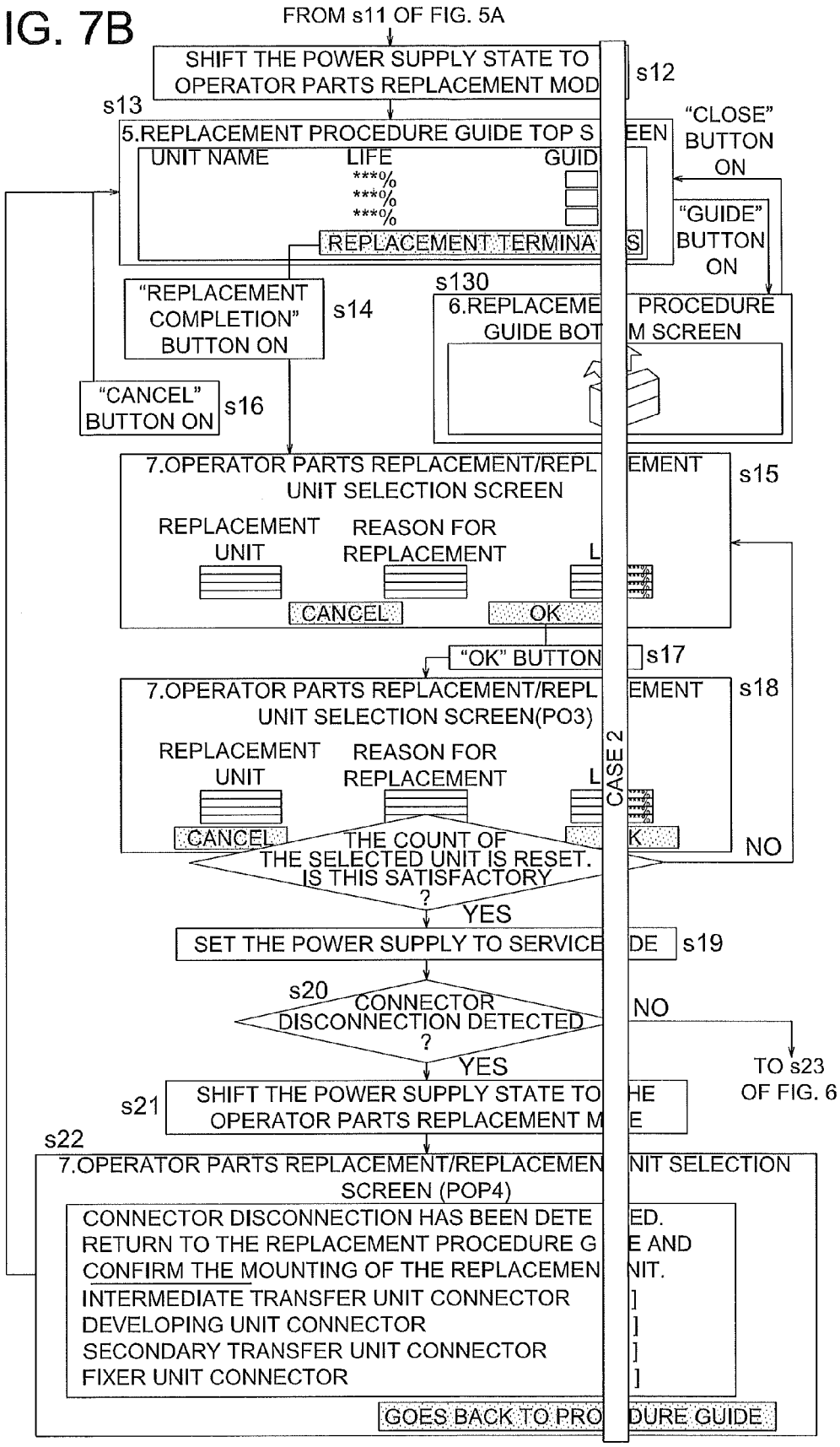
Figure 8:
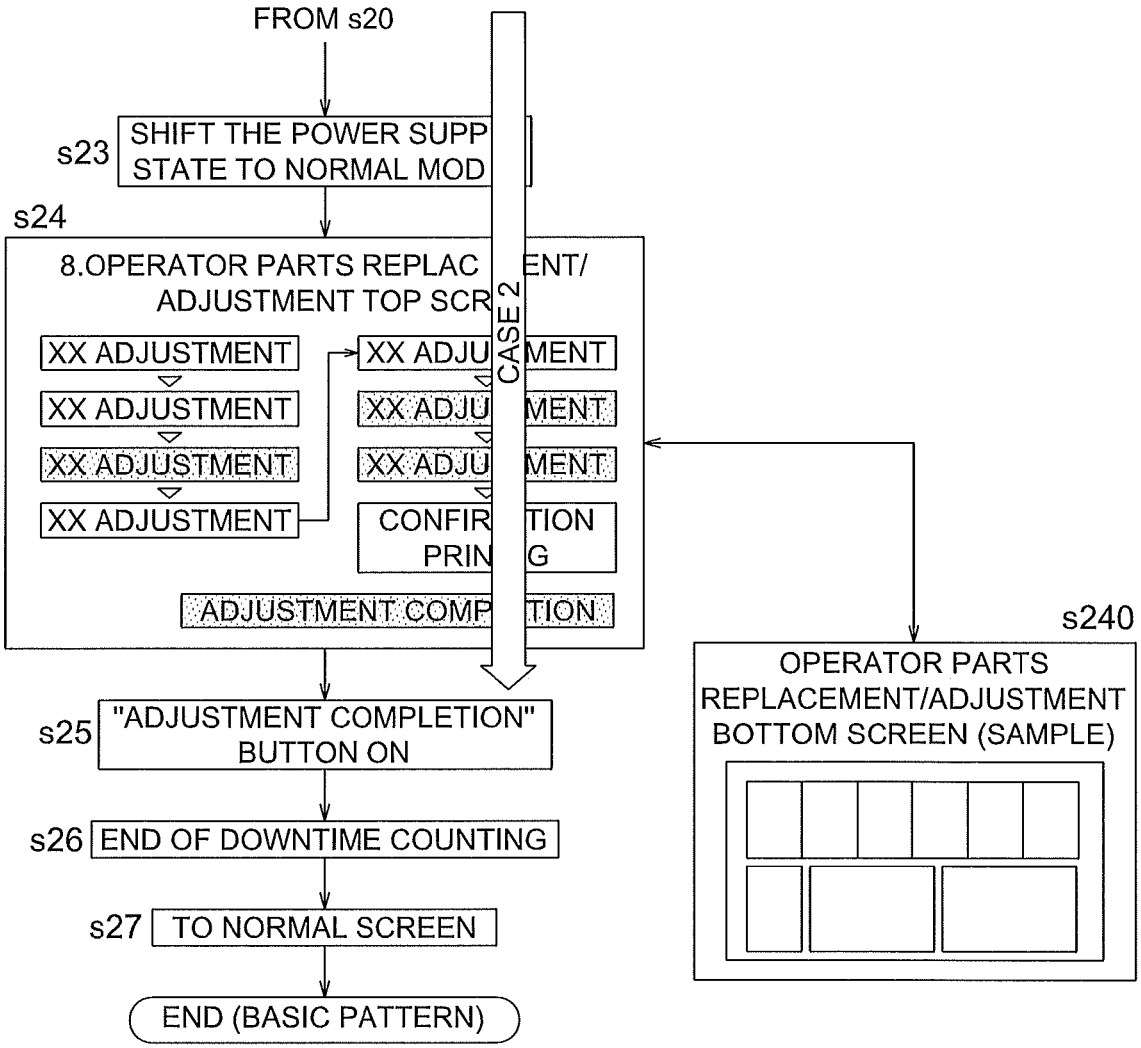
FIG. 8 is a flowchart representing the replacement control procedure when power is turned off in the middle of replacement work.

In the above description, the work is assumed to have terminated, without the power supply being turned off by the operator during the replacement work. However, if the power is turned off by the operator without replacement work having been completed and the apparatus operation is restored by the power being turned on during the replacement work, the apparatus may be damaged. To avoid this, it is preferred to set up a control procedure to handle the cases wherein the power has been turned off during the replacement work. This control procedure will be described with reference to the flowcharts in FIGS. 7A, 7B, and 8. The procedure of the replacement work is the same as that of the flowcharts in FIGS. 5 and 6. Accordingly, the same step numbers will be assigned and a detailed explanation will be omitted.

In the first place, a step is taken to set up a procedure to be taken when the power is turned off and the unit has been replaced before the replacement start notification (Step s6) is given by the operator (Case 1). In Case 1, the operation is irregular and is different from the standard work procedure wherein replacement is performed after declaration of the start declaration. Thus, even if replacement has already been completed, processing should be started from the first step when power is on in order to ensure that the subsequent procedure will be followed. When the power is turned on, the control section 10 reads the power supply mode stored in the nonvolatile memory 12. In Case 1, the normal power supply mode is stored as the power supply mode. The control section 10 starts the apparatus in the normal power supply mode.

If power is turned off (Case 2) prior to adjustment work completion declaration (Step 25) subsequent to replacement start notification (Step s6), the control section 10 reads out the power supply mode stored in the nonvolatile memory 12 when the power is on, and the operation starts in the power supply mode. In Case 2, the nonvolatile memory 12 records the power supply mode for operator parts replacement and the apparatus is started in the power supply mode. When the apparatus is started in the power supply mode, the replacement procedure guide TOP screen is displayed on the operation section 7 in the state of Step 13 so that the subsequent replacement procedure is enabled. In this case, the replacement unit selection state stored in the nonvolatile memory is read out, and the replacement work is enabled with the selection state kept unchanged. However, after the Cancel button has been pressed on the operator parts replacement/replacement unit selection screen, the replacement flow has been terminated and the downtime counting also terminates. Thus, when power is turned on or off with the Cancel button being pressed, the operation starts in the normal power supply mode.

When power is turned off after the adjustment work completion button has been turned on, the nonvolatile memory 12 records the normal power supply mode. Based on this record, the control section 10 starts the apparatus in the normal power supply mode.

According to the image forming apparatus of the present invention, the aforementioned power supply mode for operator parts replacement prefers that supply of power to at least the drive section for driving each part of the apparatus and the detecting section for performing various forms of detection inside and outside the apparatus should be cut off.

The power supply mode for operator parts replacement prefers that power should be supplied to at least the aforementioned control section and the display section. When power is supplied to the control section, it can be supplied to the control system as a whole. However, it is also possible to adopt such a structure that power is supplied to the minimum required control system, without power being supplied to the control systems for the drive section wherein power is cut off.

According to the image forming apparatus of the embodiment of the present invention, it is preferred that, in the aforementioned power supply mode for operator part replacement, the power supply at least to a drive section for driving various sections of the apparatus and a detecting section for detecting various aspects inside and outside the apparatus is cut off.

Further, it is preferred that, in the aforementioned power supply mode for operator part replacement, the power supply to the control section and the display section. The power supply to the control section can be a power supply to whole control system and can be a power supply which supplies power to minimum and necessary control system by not supplying power to a control system for drive section to which power is cut off.

In the power supply mode for operator parts replacement, the guidance and precautions for the replacement procedure can be displayed on the display section provided on the image forming apparatus. This allows an operator unfamiliar with the apparatus to perform easy and quick replacement of the parts.

The image forming apparatus has a normal power supply mode and, power supply mode for operator parts replacement as the states of power supply. The apparatus can be provided with only two modes, or can be provided with these two modes plus the service mode wherein a serviceman works on the image forming apparatus. The state of power supply in the service mode can be different from the state of power supply in the normal power supply mode and power supply mode for operator parts replacement. In this case, for example, only the supply of power to the drive section can be cut off to ensure safety. The service mode can have the same state of power supply as the state of normal power supply or the state of power supply in the power supply mode for operator parts replacement.

In the normal power supply mode, power is supplied in such a way that all the loads of the apparatus can be operated. The image forming apparatus provided with an interlock switch interlocked with the open/close-type door of the apparatus can be configured in such a way that, if the open/close-type door is opened in the normal power supply mode, supply of power to all the loads of the apparatus is cut off. When the power supply mode for operator parts replacement or service mode is selected, in the image forming apparatus provided with an interlock switch interlocked with the open/close-type door of the apparatus, power can be supplied to part of the apparatus in conformance to each power supply mode, even when the open/close-type door is opened.

Shift of the mode among the normal power supply mode, power supply mode for operator parts replacement, and service mode can be achieved in conformance to the operator's instruction. For example, shift from the aforementioned normal power supply mode to the power supply mode for operator parts replacement can be performed after receipt of the parts replacement start notification from the operator. The aforementioned notification can be provided from the operation section on the apparatus. The operation section can be installed separately from the display section or can be made of a touch panel or the like that also serves as the display section.

In the aforementioned mode shift, further conditions can be added. For example, mode shift from the normal power supply mode to the power supply mode for operator parts replacement can be performed subsequent to outputting of a confirmation sample prior to replacement of the parts or unit. To output the confirmation sample is to output the sheet with an image formed thereon in order to check the output quality and output appearance. This can be achieved by a sample outputting instruction given by the operator. When the sample is outputted prior to replacement of the parts and others, the outputted product can be checked prior to replacement of the parts and others, and the state of the apparatus prior to replacement can be identified. Further, comparison can be made with the output subsequent to replacement of parts.

Mode shift from the power supply mode for operator parts replacement to the normal power supply mode and service mode is preferably performed after receipt of the parts or unit replacement completion notification from the operator, rather than by detecting the completion of parts replacement. This is because mode shift without the operator's will is not preferred.

Further, after parts have been replaced (for example, after receipt of the parts or units replacement completion notification from the operator), the state of parts replacement is preferably detected by the apparatus, without direct shift being made from the power supply mode for operator parts replacement to the normal power supply mode.

For example, when each of the parts and unit is provided with a storage medium such as an IC tag, the storage medium is read in the process of replacement, whereby replacement of the parts or unit can be identified. Thus, in the power supply mode for operator parts replacement, power is preferably supplied to the reading section that reads data from the aforementioned storage medium. The data having been read may include the identification information of the replaced parts and unit, and the information on the type of the parts, service life, and reasons for replacement. All or part of such information can be displayed on the display section.

For example, the state of parts replacement is detected as follows: The aforementioned parts replacement completion notification is received, and the mode shift is performed from the power supply mode for operator parts replacement to the service mode. After that, a step is taken to detect the state of the detecting section for detecting various aspects inside and outside the apparatus. If supply of power to the detecting section is cut off in the power supply mode for operator parts replacement, the mode shifts to the service mode, and power can be supplied to the detecting section.

To detect the state of the detecting section, signals are exchanged with the detecting section, for example, whereby the operation and connection states of the detecting section can be identified. If the detecting section is in the normal state, replacement of parts and others is considered to be performed correctly. The state of the detecting section can be detected only for the parts to be replaced. Alternatively, since the replacement work requires connection and disconnection of the cable and others, the scope of detection can be expanded to include all the detecting sections.

When an error has been detected, a trouble may be caused if the cable is connected or disconnected with power being supplied. To avoid this, the mode is again shifted to the power supply mode for operator parts replacement. If supply of power to the detecting section is cut off in the power supply mode for operator parts replacement, such measures as cable reconnection can be taken in safe environments.

After parts have been replaced (for example, after the parts or unit replacement completion notification has been given by the operator), the mode is shifted from the power supply mode for operator parts replacement to the normal power supply mode. After that, adjustment work for the parts or units having been replaced should preferably be performed. This adjustment work is preferably performed when no error has been detected by the detecting section. The adjustment work can be performed in conformance to the operator's instruction, or can be performed automatically for the possible items.

After parts have been replaced (for example, after the parts or unit replacement completion notification has been given by the operator), means are preferably provided to enable the operator to input the information on the start of adjustment work subsequent to replacement of the parts and work completion notification. This makes it possible to start the required adjustment work automatically in response to the notification of the start of adjustment work or to select adjustment items. In this case, work time samples can be collected by counting the time from the start of replacement to the completion of all the replacement work.

In the power supply mode for operator parts replacement, the power switch is turned off from replacement start notification by the operator to the replacement completion notification. Then the power switch is turned on again. In this case, the apparatus operation is preferably started after the state of power supply has been changed into the power supply mode for operator parts replacement, not in the normal power supply mode. If the operation is started in the normal state of power supply by turning on and off the power switch during the process of parts replacement, a problem may be caused. The problem can be avoided by starting the operation in the power supply mode for operator parts replacement.

The power supply mode is stored in the nonvolatile storage section such as a flash memory and the stored contents are changed at the time of mode shift. This allows the operation to be started in the state of power supply when the power switch is turned off.

According to the image forming apparatus of the embodiment of the present invention, the image forming apparatus for forming an image based on the image data includes a power source for supplying power to various sections of the apparatus, a display section for displaying information, and a control section for controlling operations of the apparatus, wherein the control section is provided with a normal power supply mode assuming the normal state of power supply, and a power supply mode for operator parts replacement which assumes the state of power supply different from the aforementioned normal power supply mode when parts or units of the apparatus are replaced by the operator. Thus, when parts or units of the apparatus are replaced by the operator, the power supply mode for operator parts replacement is selected, whereby safe and reliable replacement work is ensured.

For example, when units are replaced, this arrangement prevents the apparatus from being damaged by connection and disconnection of a live line (connection and disconnection of the connection while power is supplied).

If power is supplied to the display section in the power supply mode for operator parts replacement, the operator is allowed to perform reliable work by referring to the replacement work procedure. Further, when replacement has been completed, the operator is allowed to check the state of the replacement unit. Even if power has been turned off in the middle of replacement work, the state of power supply is kept unchanged. This ensures continued safe replacement work even if the power is turned on again.

The present invention has been described with reference to the embodiment. It is to be expressly understood, however, that the present invention is not restricted thereto. The present invention can be embodied in a great number of variations with appropriate modifications or additions, without departing from the technological spirit and scope of the invention claimed.

What is claimed is:

1. An image forming apparatus for forming an image based on image data, comprising:

a power source for supplying power to various sections of the apparatus;

a display section for displaying; and a control section for executing a controlling regarding operations of the apparatus, wherein the control section is provided with a normal power supply mode representing a state of normal power supply, and a power supply mode for operator part replacement representing the state of power supply different from said normal power supply mode, the power supply mode for operator part replacement to which an operator changes the state of power supply on changing a part or a unit of the apparatus, and the control section is further provided with a service mode which represents a state of a power supply mode when a service person works on the image forming apparatus.

2. The image forming apparatus described in claim 1, wherein the service mode is a mode in which a power supply to a drive section which drives each section of the apparatus is cut off.

3. The image forming apparatus described in claim 1, wherein a state of power supply of the service mode is the same as that of the normal power supply.

4. The image forming apparatus described in claim 1, wherein the control section performs a shift from the normal power supply mode to the power supply mode for operator part replacement after receiving a replacement start notification of part or unit by the operator.

5. The image forming apparatus described in claim 1, wherein the control section performs a shift from the normal power supply mode to the power supply mode for operator part replacement after outputting of a confirmation sample print prior to replacement of the part or unit.

6. The image forming apparatus described in claim 1, wherein, in case when a power switch is turned off subsequent to a replacement start notification by the operator prior to a replacement completion notification and then the power switch is turned on again, the control section starts the apparatus operation after shifting a state of power supply to the power supply mode for operator part replacement.

7. The image forming apparatus described in claim 1, wherein the control section is provided with a nonvolatile storage section in which the state of power supply is stored, stores a shift of the power supply mode in the storage section, and, when the power operation is started, starts the apparatus operation with the power supply modes stored in the storage section.

8. The image forming apparatus described in claim 1, wherein the control section supplies power to a reading section which reads information of storage medium attached to a replacement part or a replacement unit when the power supply mode is the power supply mode for operator part replacement.

9. The image forming apparatus described in claim 1, wherein, when the power supply mode is the power supply mode for operator part replacement, the control section supplies power to a reading section which reads information of storage medium attached to a replacement part or replacement unit and changes a display content of the display section according to the information.

10. The image forming apparatus described in claim 1, comprising an operation section to which an input by the operator is accepted.

11. The image forming apparatus described in claim 1, wherein the control section performs a shift from the power supply mode for operator part replacement to the normal power supply mode or to the service mode, after receiving a replacement completion notification of part or unit by the operator.

12. The image forming apparatus described in claim 11, wherein the control section detects a state of a detecting section for detecting various aspects inside and outside the apparatus after receiving the replacement completion notification and performing the shift from the power supply mode for operator part to the service mode.

13. The image forming apparatus described in claim 12, wherein, when an error has been detected at the detecting the state of the detecting section, the control section perform a shift of power state again to the power supply mode for operator part replacement.

14. The image forming apparatus described in claim 12, wherein the detecting the state of the detecting section is a detecting of an existence of a removal of a connector connecting to the detecting section.

15. The image forming apparatus described in claim 12, wherein, when an error has not been detected at the detecting the state of the detecting section, the control section performs a shift of power state to the normal power supply mode.

16. The image forming apparatus described in any claim 11, wherein, after receiving the replacement completion notification of part or unit by the operator and performing the shift from the power supply mode for operator part replacement to the normal power supply mode, the control section enables an adjustment work for the part or unit received the replacement completion notification to be performed.

17. The image forming apparatus described in claim 16, wherein the control section performs a part of or all of the adjustment work automatically.

18. The image forming apparatus described in claim 16, wherein the control section enables a start notification and a completion notification of the adjustment work to be input.

19. The image forming apparatus described in claim 16, wherein, in case when a power switch is turned off subsequent to the replacement start notification by the operator prior to an adjustment completion notification and then the power switch is turned on again, the control section starts the apparatus operation after shifting a state of power supply to the power supply mode for operator part replacement.

20. An image forming apparatus for forming an image based on image data, comprising:

a power source for supplying power to various sections of the apparatus;

a display section for displaying; and a control section for executing a controlling regarding operations of the apparatus, wherein the control section is provided with a normal power supply mode representing a state of normal power supply, and a power supply mode for operator part replacement representing the state of power supply different from said normal power supply mode, the power supply mode for operator part replacement to which an operator changes the state of power supply on changing a part or a unit of the apparatus; and wherein, in the power supply mode for operator part replacement, at least a supply of a power to a drive section for driving various sections of the apparatus and to a detecting section for detecting a sheet position is cut off.

21. An image forming apparatus for forming an image based on image data, comprising:

a power source for supplying power to various sections of the apparatus;

a display section for displaying; and a control section for executing a controlling regarding operations of the apparatus, and the control section includes a mechanical control section portion and a remaining control section portion;

wherein the control section is provided with a normal power supply mode representing a state of normal power supply, and a power supply mode for operator part replacement representing the state of power supply different from said normal power supply mode, the power supply mode for operator part replacement to which an operator changes the state of power supply on changing a part or a unit of the apparatus; and wherein, in the power supply mode for the operator part replacement, a supply of a power to a part of each section of the apparatus, including the mechanical control section portion, is cut off and a power is supplied at least to the remaining control section portion and to the display section.

22. An image forming apparatus for forming an image based on image data, comprising:

a power source for supplying power to various sections of the apparatus;

a display section for displaying; and a control section for executing a controlling regarding operations of the apparatus, wherein the control section is provided with a normal power supply mode representing a state of normal power supply, and a power supply mode for operator part replacement representing the state of power supply different from said normal power supply mode, the power supply mode for operator part replacement to which an operator changes the state of power supply on changing a part or a unit of the apparatus; and wherein the control section allows the display section to display a guidance for the replacement procedure when the power supply mode is the power supply mode for operator part replacement, and the guidance includes instructions for part replacement.

* * * * *